United States Patent [19]

Hutton

[11] 4,318,471

[45] Mar. 9, 1982

[54] ARTIST'S LAP EASEL

[76] Inventor: Robert P. Hutton, Box 167, Marshall University, Huntington, W. Va. 25707

[21] Appl. No.: 143,460

[22] Filed: Apr. 24, 1980

[51] Int. Cl.[3] ..... A47B 97/04

[52] U.S. Cl. ..... 206/214; 224/267; 248/459

[58] Field of Search ..... 206/214, 224, 1.7, 1.8; 248/441 R, 459; 108/43; 224/267

[56] References Cited

U.S. PATENT DOCUMENTS

| | | | |
|---|---|---|---|
| 348,124 | 8/1886 | Hood | 206/214 X |
| 434,040 | 8/1890 | Andrews | 206/214 X |
| 597,481 | 1/1898 | Graham | 206/214 |
| 2,701,173 | 2/1955 | Senior et al. | 224/267 X |
| 4,143,847 | 3/1979 | Cross | 248/459 |

*Primary Examiner*—Steven M. Pollard

*Attorney, Agent, or Firm*—Fisher, Christen & Sabol

[57] ABSTRACT

An artist's lap easel is made up of a number of flat rectangular panels which are hingedly joined together so that they can be folded flat one upon another when not in use and opened up to provide a tilted easel surface with an adjoining horizontal palette surface to one side of the easel. A portion of a supporting panel can be tilted upwardly and separably fastened to the easel to support it when tilted and a portion of the palette section can be similarly upwardly tilted, the tilted portion being provided with at least one pocket for supplies. At least one of the panels includes a cutout portion to serve as a carrying handle.

13 Claims, 5 Drawing Figures

10
11
12
15
16
17
19
20
21
22
28
29
30
31
32
33
34
35
36
37
38
39
41
42
43
44
46
47
48
49

ARTIST'S LAP EASEL

BACKGROUND OF THE INVENTION

This invention relates to artist's materials, and more particularly to a portable light weight easel for sketching, or painting, which can be supported on the artist's lap when in use to support the medium being used at an appropriate angle with places to conveniently hold pencils, pens, brushes and other supplies such as ink, coloring materials and palette, etc. In addition, the easel may be folded quickly, with the aforementioned supplies contained in appropriate compartments, into a substantially flat carrying case having a carrying handle which can be utilized, not only for carrying the materials from place to place, but for hanging easels in a systematic way on a rack which accommodates a number of easels, such as when a group of students are involved.

Sketching and drawing is often done to field trips or in brief periods of time available to the artist during his daily travels. Traditionally, the artist has carried a sketch book and a few pencils or a pen when outside his well equipped studio. However, the sketch book alone is awkward to handle and imposes limits on the artist's ability in the field.

Various attempts to alleviate these problems have been made in the past by constructing folding easels as disclosed in U.S. Pat. Nos. 2,589,320; 3,833,098; 1,593,166; 1,527,014; 2,530,605 and 346,547. Another approach, which involves the provisions of means for supporting a drawing board with one hand is shown in U.S. Pat. No. 2,896,328, while U.S. Pat. No. 1,613,440 discloses a form of attache case containing numerous compartments accessible when in use with a shoulder strap for supporting the case.

SUMMARY OF THE INVENTION

The basic concept of the present invention is to employ a number of substantially rigid, waterproof sheet members hingedly connected together in such a manner that they can be folded flat one upon another when not is use to form a relatively thin rectangular package having an overall size only slightly larger than the paper, or other material, upon which the artist desires to execute his work.

In a preferred form sheets of heavy cardboard are covered with a waterproof vinyl, or similar, plastic sheet material, the plastic material being applied to the surfaces of adjacent sheets of rigid material so that it serves to hingedly connect the rigid members together. For example an easel section may comprise two rigid members hinged together along their bottom margins so that with the lower member supported on the lap, the upper member may be tilted upwardly toward the user to properly support the sketch paper. To support the upper member in this position, the lower member may comprise two rigid members hinged together along a line parallel to the first mentioned hinge, with the result that the upper portion of the lower member can be tilted upwardly underneath the easel member to support it. To ensure that the support will be firm, a set of fasteners may be employed to join the top edge of the lower member to the lower surface of the easel. In particular a fastening means of the type known as Velcro is eminently suitable for this purpose.

A palette area composed of another sheet of rigid material may be disposed to one side, or the other, of the aforementioned easel section, this sheet being also hingedly joined to the first mentioned lower rigid member along a common margin at right angles to the hinge connection for the easel. Thus, the palette section, when opened out will lie flat, either to the left or right of the easel and in a horizontal plane to support containers for liquid materials, pens, pencils, a palette, or other needed materials.

In addition, various pockets may be arranged on the outer surfaces of the easel section and palette section to contain supplies. Since these pockets are on the outside they do not interfere with folding the panels together when not in use. However, these pockets may be closed by flaps which fold over toward the inside so that access may be easily had when the table is in use. Also, the back of the panel forming the easel may be covered with a sheet of material joined to the easel along three margins to form a pocket to contain extra sheets of paper.

In order to maintain the palette section in horizontal position on the user's lap and maintain alignment of the panels a series of aligned loops may be provided in the adjacent hinged panels and a long rod, or dowel, may be inserted through these loops when the panels are opened out in order to hold the panels in fixed relationship to each other.

An adjustable strap has one end fixed to one of the panels so that the free end may be wrapped under one thigh of the user and detachably fastened at various positions spaced from the fixed end in order to hold the entire assembly in place so that both hands may be free to work.

DETAILED DESCRIPTION OF A PREFERRED EMBODIMENT OF THE INVENTION

Figures 1, 2:
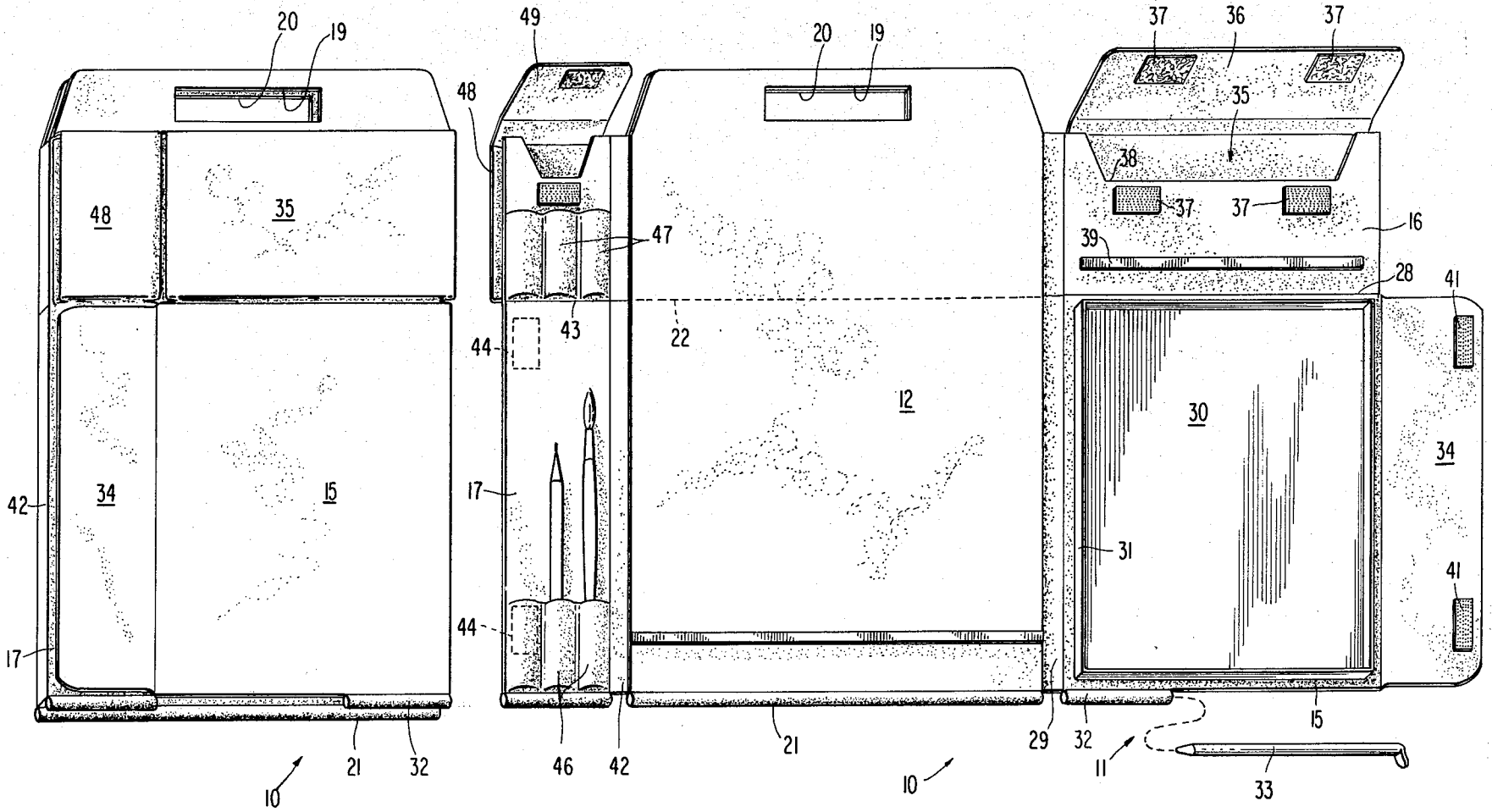
FIG. 1 is a plan view of a preferred form of lap supported portable work table in accordance with the invention when in its closed condition.
FIG. 2 is a plan view of the table of FIG. 1 in partially open position with the easel panel lying flat on a lower support panel.
Figure 3:
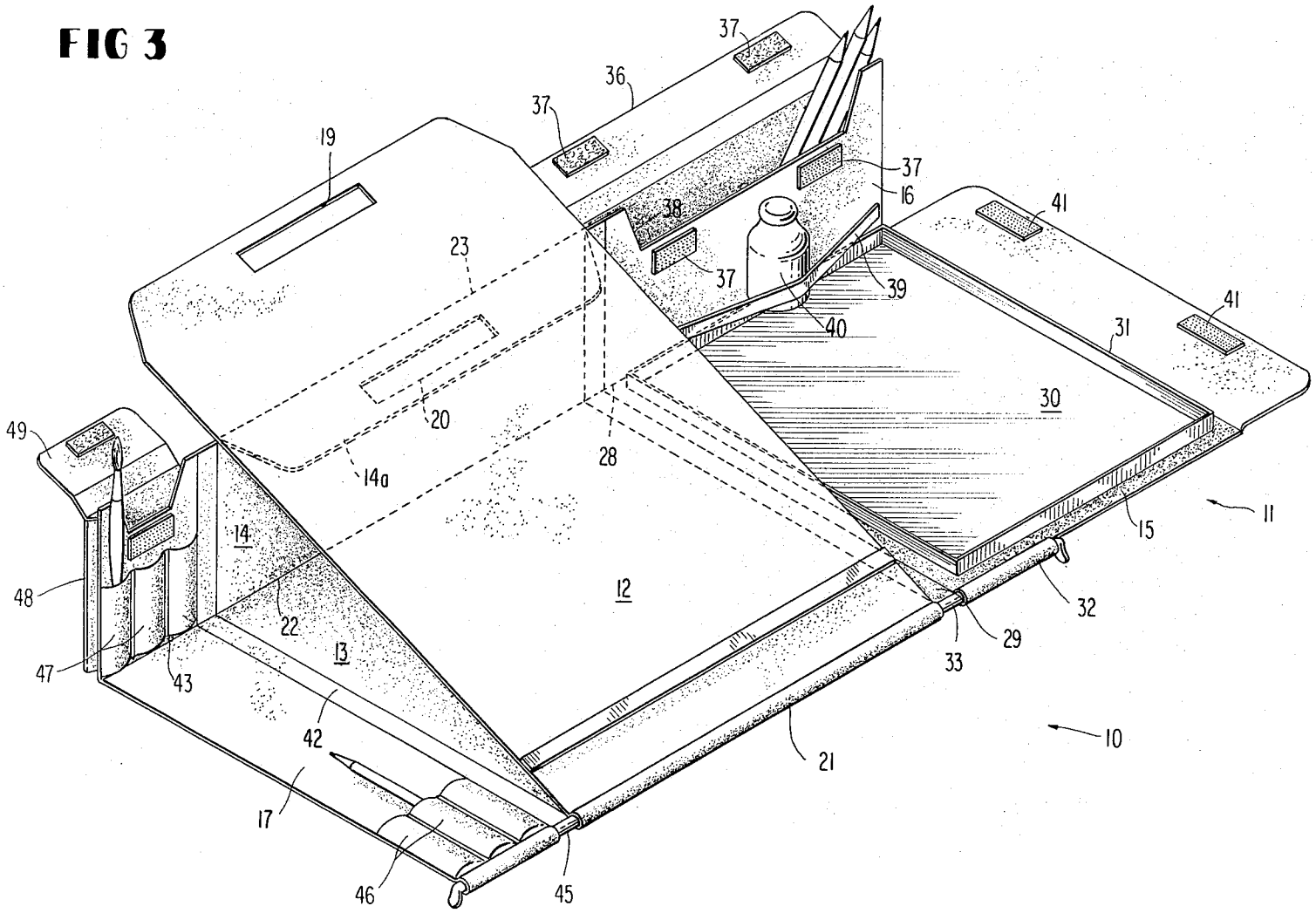
FIG. 3 is a perspective view as observed from the lower left of FIG. 2 with the easel panel raised to a tilted position and supported by an upwardly raised portion of a support panel.

In the drawings numeral 10 indicates the easel section generally, while numeral 11 indicates a palette section generally. As shown, the palette section is disposed to the right of the easel but it will be understood that for those who prefer it their relative positions could be reversed without altering the basic relationships of the various elements of the invention.

The easel section comprises three substantially rigid flat panels 12, 13 and 14 which are hingedly connected together, and the palette section comprise two substantially rigid panels 15 and 16 hingedly connected together and to the panels 13 and 14, as will be explained. Two other substantially rigid, relatively narrow, panels 17 and 18 which provide additional storage space as well as forming part of the closure means, are also hingedly joined together and to panels 13 and 14 on the side opposite to work panels 15 and 16.

While each of the panels referred to above can be fabricated as individual units from a material such as plywood or metal, to be joined together by separately attached hinges, it has been found practical to use a relatively inexpensive material such as heavy cardboard and to adhesively apply a thin veneer of a flexible sheet material, such a vinyl plastic or the equivalent to each surface to provide a finished surface appearance to the basic stiffening material. At the same time the dimensions of the applied flexible material can be extended beyond the appropriate margins of the stiffening material to provide the requisite hinging means between the panels. The excess flexible sheet material along the margin of one panel can be joined to the excess material of the adjacent panel although it is preferable to employ a single large sheet of material spread out over both surfaces of all of the assembled stiffening members, the areas between the stiffening material being welded or sealed together to provide hinges, or fold lines.

Panel 12 serves as a supporting surface for a sheet of paper, or other material the artist is using and obviously should provide an area at least as large as that of the paper commonly used. In one form of the invention, not to be considered as limiting, panel 12 was about $11\frac{1}{4}$ inches wide by $14\frac{1}{2}$ inches from front to back. This size allows for full support while providing an extension at the top into which an opening 19 can be cut to provide a carrying hand hold. Panels 13 and 14 should be at least equal in width to panel 12 and their total length is, preferably, also the same as that of panel 12 in order to allow the provision of a hand hold opening 20 in the flap portion 14*a* of panel 14 which is in alignment with opening 19 when the assembly is collapsed for carrying. Panel 12 is hingedly connected along its lower margin to the lower margin of panel 13, this hinge being formed by extending the two sheets of flexible material which covers both exposed surfaces of these panels so as to bridge the gap between the two. In this case a rather wide gap between the two panels is provided, and the sheets are rolled over upon themselves and secured, as by electronic welding, to form a small tube 21 extending along the bottom of panel 12 to form a gutter to prevent articles from sliding off the panel when tilted. The tube serves another purpose to be described later.

Figures 4, 5:
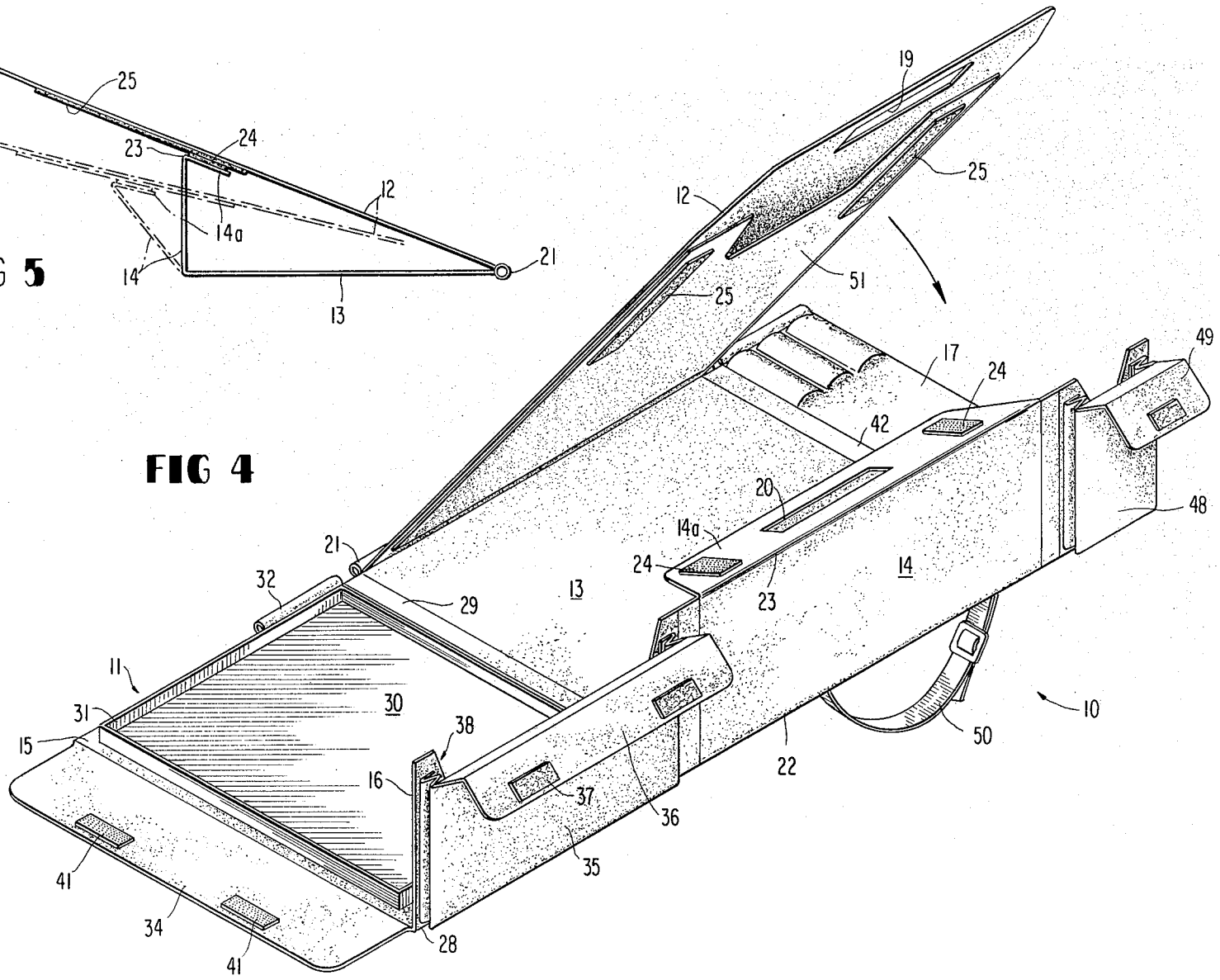
FIG. 4 is a perspective view of the table as viewed from the upper right of FIG. 2 and with the easel panel detached from its support and raised to a vertical position.
FIG. 5 is a cross-section in elevation from the left side of the table when the easel is in its tilted position.

Panel 14 is hinged along its lower margin to the upper margin of panel 13 by extending the flexible sheets covering the panels to form a fold line. Along the upper margin of panel 14 there is a narrow flat portion 14*a* which is similarly hinged to panel 14 along the fold line 23. The result is that with panel 13 placed on a supporting surface, such as the artist's knee, panel 14 can be folded into an upright position to contact the under side of panel 12 to hold it in an upright position as shown in FIG. 5. The flap portion 14*a* is folded forwardly to lie flat against the panel 12, and by shifting the vertical angle of panel 14 backward, or forward, various angles for panel 12 can be obtained. The desired angle can be maintained by the provision of cooperating detachable fastener means, such as the strips 24 of Velcro fabric material on flap 14*a* and 25 on the panel 12 as shown in FIG. 4. Velcro is described in U.S. Pat. No. 3,009,235, and comprises two separable members each provided with a very large number of closely spaced interengageable hooking elements, certain of the hooking elements comprising hooks made of flexible resilient material and certain of the hooking elements comprising loops of flexible resilient material arranged closely together on a base of sheet material so that when the separable members are brought together in face-to-face engagement the hooks on one member engage with loops on the other member. The members can be separated by progressively pulling them apart. If the strips 25 are elongated, it will permit engagement with strips 24 in various positions so that the angle of panel 14 can be changed to alter the angle of tilt of easel panel 12. It will be understood a series of snap fasteners placed in rows on panel 12 for engagement with a pair of coacting fasteners on flap 14*a* could be used but would not permit the same flexibility.

The palette section 11 may comprise a palette panel 15 and a supply panel 16 each preferably fabricated in a manner similar to that of panels 12, 13 and 14 by covering a stiff sheet of material with flexible sheeting on both sides, with portions of the flexible material extending beyond the margins serving as hinges, such as along the fold line 28 between panels 15 and 16 and in the elongated narrow area denoted by numeral 29 which joins panels 15 and 16 to panels 13 and 14 respectively. The width of the area 29 is somewhat greater than at other fold lines because, when closed the panels 15 and 16 will overlie panel 12. In addition, panel 15 may be provided with a plastic or metal mixing palette having low walls 31 surrounding it to confine liquids within the area, and the width of the hinge area 29 must be sufficient to accommodate the palette walls and stored paper when the table is closed.

The lower margin of panel 15 is preferably aligned with the lower margins of panels 12 and 13 and along at least a portion of the length of this margin of panel 15 the flexible sheet covering is formed as a tube 32 which will be in alignment with tube 21 when the table is opened. In this position an elongated rod, or dowel, 33 can be inserted within the aligned tubes to reinforce the support for panel 15 when opened. The primary support is provided by the fact that panel 16, due to its interconnection with panel 14, will be tilted upwardly when the latter panel is tilted to support easel 12. Panel 15 is provided with a closure flap 34, preferably extending along the margin opposite to fold line 29. A pocket 35, formed of fabric, or plastic sheet material may be provided on the rear surface of panel 16, the material of the pocket extending upwardly to form a closure flap 36 which folds downwardly over the front of the panel to be secured by fasteners 37. To provide easy access to the pocket the top margin of the panel may be cut away as at 38. An elastic band 39 may be secured at its ends in a stretched condition across the front of panel 16 to act as a holder for an ink bottle 40, or other material.

When the lap table is folded for carrying, the closure flap 34 could be secured to the back of panel 13 by means of fasteners coacting with fasteners 41 on the flap itself. However, in the form shown there is additional storage space provided by the narrow panels 17 and 18, hingedly secured to panels 13 and 14 along fold area 42 which should have sufficient width to accommodate stored papers, as in the case of hinge area 29. These panels are also hingedly secured to each other along the transverse fold line 43 in alignment with fold line 22. These panels are relatively stiff and are formed in the same way as the others. By the placement of fasteners 44 on the back surface of panel 17 which will coact with fasteners 41 on closure flap 34 and by making the combined widths of panels 15 and 17 approximately equal to the width of easel panel 12 it is possible for panels 15 and 17 to be folded over on easel palette 12 from opposite sides, with their face margins lying adjacent to each other. Closure flap 34 when overlies panel 17 and fasteners 41 can be engaged with coacting fasteners 44. The lower margin of panel 17 may be provided with a tubular portion similar to, and in alignment with, the tubular margin 21 and a rod, or dowel, 45 may be inserted through the two tubular portions to stabilize panel 17 when open. A series of elongated pockets 46 may be provided on the top of the panel in which pens, brushes, pencils or dowels 33 and 45 can be stored when not in use. Panel 18, when the easel is in use, will be tilted upwardly, in which position it also stabilizes the panel 17. It also can be provided with storage pockets 47 on its upper surface, as well as a large pocket 48 on its back surface having a closure flap 49.

If conditions under which the lap table is being used are windy a stabilizer in the form of an adjustable strap 50 may be supplied. One end may be permanently secured to the under side of panel 13 so that the free end may be passed under the thigh of the user and detachably secured by fasteners (not shown) at one of several spaced locations on the under side of the panel. A further optional feature is the provision of a storage pocket 51 for a supply of sketching paper, comprising a sheet of vinyl, or other sheet material, secured along three margins to the back of the easel panel 12 and open at the top.

I claim:

1. An artist's lap easel comprising a plurality of thin generally rectangular panels hingedly joined together at certain of their respective margins to enable said panels to be folded one upon another for carrying and to provide when opened for use:

a supporting panel hingedly joined to an easel panel at a common adjacent margin to provide a first fold line for upwardly tilting of the easel panel;

said supporting panel comprising two substantially rigid sheets hingedly joined together along a second fold line parallel with and spaced from the first fold line, one of the sheets being upwardly tilted to position the easel panel when in use, and detachable fastener means to maintain said adjusted tilted position;

a palette panel hingedly joined to said supporting panel along a third fold line normal to said second fold line to be supported coplanar with said supporting panel and to one side of the tilted easel panel when in use;

said palette panel comprising two substantially rigid sheets hingedly joined together along a fold line in alignment with said second fold line, that portion of the palette panel which is joined to the upwardly tiltable portion of the supporting panel being provided with a pocket accessible from the top when so tilted.

2. A lap easel as defined in claim 1, wherein said fastener means comprises flap means attached to said upwardly folded sheet to lie flat against the under side of the easel panel and two coacting strips of Velcro material secured respectively to said flap means and the under side of the easel panel.

3. A lap easel as defined in claim 1, wherein said third fold line is positioned to enable the palette panel to be folded over the easel panel when closed.

4. A lap easel as defined in claim 3, wherein a narrow auxiliary panel is hingedly joined to said supporting panel along a fourth fold line at the margin parallel to and opposite to the margin at the third fold line, said third and fourth fold lines being positioned to enable the palette panel and auxiliary panels to be folded over the easel panel when closed.

5. A lap easel as defined in claim 4, wherein the respective widths of said palette panel and auxiliary panels are such that the latter panels lie in the same plane when folded over the easel panel.

6. A lap easel as defined in claim 5, wherein one of said latter panels is provided with a closure flap to overlie the other of the latter panels when closed, said flap and other latter panel being provided with coacting separable fasteners for securing the table in closed position.

7. A lap easel as defined in any one of claims 4, 5 or 6, wherein said auxiliary panel is subdivided into two substantially rigid sheets hingedly joined to each other along a fold line in alignment with said second fold line, that portion of the auxiliary panel which is joined to the upwardly tiltable portion of the supporting panel being provided a pocket accessible from the top when so tilted.

8. A lap easel as defined in any one of claims 1, or 4, wherein at least one of said panels is provided with an opening to serve as a carrying handle.

9. A lap easel as defined in any one of claims 1, or 4, wherein said supporting panel includes an adjustable band to encircle the thigh of the user when the table is in use.

10. A lap easel as defined in any one of claims 1, or 4, wherein a pair of adjacent panels hinged to each other are provided with horizontally extending elongated tubular portions in axial alignment with each other to receive therein an elongated rod to assist in maintaining said pair of panels in planar alignment.

11. A lap easel as defined in claim 10, wherein said tubular portions are disposed along the lower free margins of said pair of panels.

12. A lap easel as defined in claim 11, wherein a third panel is hingedly joined to one of said pair of panels, said third panel being also provided with a tubular portion in axial alignment with one of said first-mentioned tubular portions to receive therein a rod to assist in maintaining planar alignment of the third panel with said pair of panels.

13. A lap easel as defined in claim 1 wherein that portion of the palette panel which is joined to the upwardly tiltable portion of the supporting panel is provided with a pocket accessible from the top when so tilted.

* * * * *